US007302780B2

(12) United States Patent
Sprague

(10) Patent No.: US 7,302,780 B2
(45) Date of Patent: Dec. 4, 2007

(54) MODULAR RAIL SYSTEM

(75) Inventor: Gary Sprague, Redondo Beach, CA (US)

(73) Assignee: C. R. Laurence Company, Inc., Los Angeles, CA (US)

( * ) Notice: Subject to any disclaimer, the term of this patent is extended or adjusted under 35 U.S.C. 154(b) by 0 days.

(21) Appl. No.: 10/339,703

(22) Filed: Jan. 8, 2003

(65) Prior Publication Data

US 2004/0128931 A1 Jul. 8, 2004

(51) Int. Cl.
*E04C 3/30* (2006.01)

(52) U.S. Cl. ..... 52/780; 52/781

(58) Field of Classification Search ..... 52/780, 52/781, 241, 242, 243, 299
See application file for complete search history.

(56) References Cited

U.S. PATENT DOCUMENTS 4,158,936 A * 6/1979 Fulton ..... 52/242
4,235,049 A * 11/1980 Marinoni et al. ..... 49/493.1
4,450,658 A * 5/1984 Legeai ..... 52/126.3
4,655,025 A 4/1987 Marinoni
4,680,903 A 7/1987 Horgan, Jr.
4,713,918 A * 12/1987 Cioffi ..... 174/48
4,763,453 A 8/1988 Horgan, Jr.
4,833,848 A * 5/1989 Guerin ..... 52/242
4,918,886 A * 4/1990 Benoit et al. ..... 174/48
4,932,181 A * 6/1990 Baxter et al. ..... 52/242
5,038,534 A * 8/1991 Pollock ..... 52/126.4
5,056,285 A * 10/1991 Frascaroli et al. ..... 52/243
5,062,246 A * 11/1991 Sykes ..... 52/126.4
5,069,010 A 12/1991 Trainor, Jr. et al.
5,345,737 A 9/1994 Latchinian
5,444,958 A 8/1995 Lu
5,483,775 A * 1/1996 Redman ..... 52/204.62
5,682,719 A * 11/1997 Huang ..... 52/775
5,694,722 A 12/1997 Husting et al.
5,845,439 A 12/1998 Hendley
6,295,775 B2 * 10/2001 Osterman et al. ..... 52/220.7
6,493,995 B2 * 12/2002 McKenzie ..... 52/36.4
6,546,675 B1 * 4/2003 Adderton ..... 52/71

* cited by examiner

*Primary Examiner*—Kimberly T. Wood
(74) *Attorney, Agent, or Firm*—Mitchell P. Brook; Luce, Forward, Hamilton & Scripps LLP

(57) ABSTRACT

A modular rail system for holding a panel includes individual components that can be mixed and matched making it easy to customize to fit any length and provides for the use of an array of accent materials. The modular rail system includes at least first and second columns and first and second rails extending between the columns, wherein the columns and first rail each includes a recess for securing one edge of the panel.

30 Claims, 4 Drawing Sheets

MODULAR RAIL SYSTEM

FIELD OF THE INVENTION

The present invention is directed to modular rail systems involved in holding panels.

BACKGROUND OF THE INVENTION

Rail systems are conventionally used to mount panels, such as panes of glass in a doorway opening, or as a wall partition or sidelite. Usually, rail systems consist of a continuous extruded metal rail secured along one or more edges of the panel. Rail systems of this kind suffer from a number of disadvantages.

One disadvantage of conventional rail systems is that the continuous extruded metal rail has length limitations and unsightly joints are formed when abutted to accommodate large openings. Another disadvantage is that it is not feasible to bend such rails around corners for an aesthetically pleasing appearance. Therefore, there exists a need for a rail system that is easy to customize to fit any length and includes rails that are capable of being bent around corners without destroying the appearance of the rails.

A further disadvantage of conventional rail systems is that, since they are usually one-piece systems, it is impossible to mix and match finishes within the same rail. Therefore, there exists a need for a rail system that is modular such that individual modular components can be mixed and matched.

An additional disadvantage of conventional rail systems is that their long lengths make it very difficult to handle and ship without damage to the fragile finishes. This is true both for the manufacturer and the installer. Therefore, there exists a need for a modular rail system having components that do not exceed a predetermined length.

SUMMARY OF THE INVENTION

The present invention alleviates to a great extent the disadvantages of known rail systems by providing a rail system that is modular, making it easy to customize to fit any length. Since the rail system is modular, it includes individual components that can be mixed and matched to form an aesthetically pleasing rail system. Further, the modular rail system eliminates the need for glass notching to be done prior to installation of a glass door, when compared to doors that use patch fittings or patch rails, by using rail components to span a gap caused by raising the glass door off the ground. The invention also provides the ability to incorporate accent materials including, but not limited to, wood, stone, glass, treated metals and plastics.

The modular rail system of the present invention further provides the advantage of modular components that do not exceed a predetermined. The shorter lengths lessen the difficulty in handling the rails as well as provide the opportunity to include a wider variety of accent materials.

Some embodiments of the present invention include a modular rail system for holding a panel including first and second columns and first and second rails extending between the columns, wherein the first column, second column and first rail each includes a recess for securing one edge of the panel.

Other embodiments include a modular rail system for holding at least one panel including first, second and third columns, and first and second tiers of rails extending between the columns, wherein the first column, second column, third column and first tier of rails each includes a recess for securing one edge of the at least one panel.

These and other features and advantages of the present invention will be appreciated from review of the following detailed description of the invention, along with the accompanying figures in which like reference numerals refer to like parts throughout.

DETAILED DESCRIPTION OF THE PREFERRED EMBODIMENTS

Figure 1:
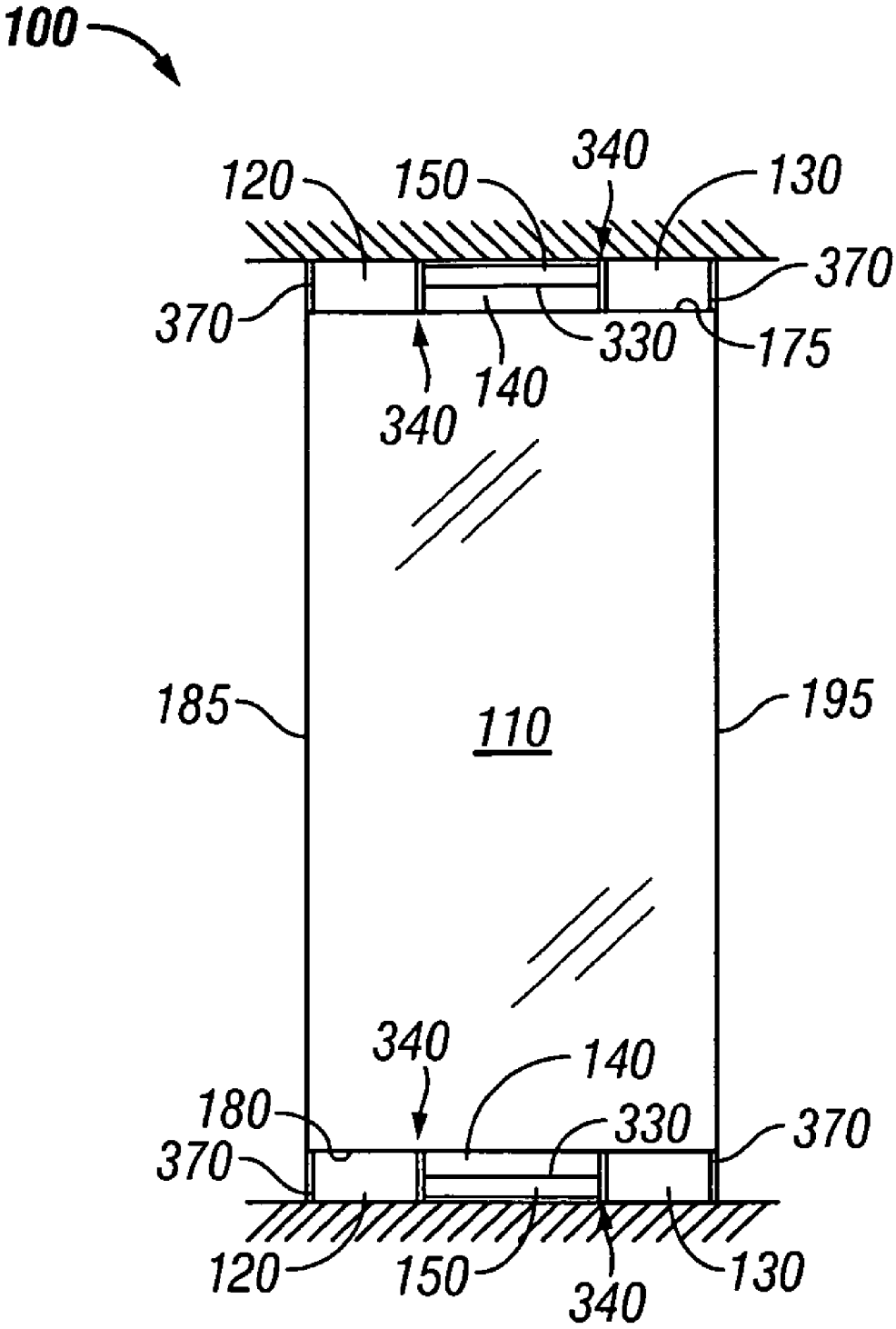
FIG. 1 is a front view of an embodiment of an assembly in accordance with the present invention.

FIG. 1 shows an embodiment of a modular rail system 100 for holding a panel 110 according to the present invention. In this description, a modular rail system refers to a rail system that is constructed using a plurality of standardized components. The modular rail system 100 extends along a bottom edge 180 of the panel 110, which may comprise a pane of glass, sidelight, board, sheet or any other type of vertically standing panel. In this embodiment, the panel 110 is a pane of glass for a door.

In the illustrated embodiment, the modular components include a first clamping column 120, a second clamping column 130, a first rail 140 and a second rail 150. The first and second rails 140,150 are connected to the first and second columns 120,130 such that the rails 140,150 are positioned between the columns 120,130. According to other embodiments, additional modular components can be used to construct a rail system of any length.

Figure 3:
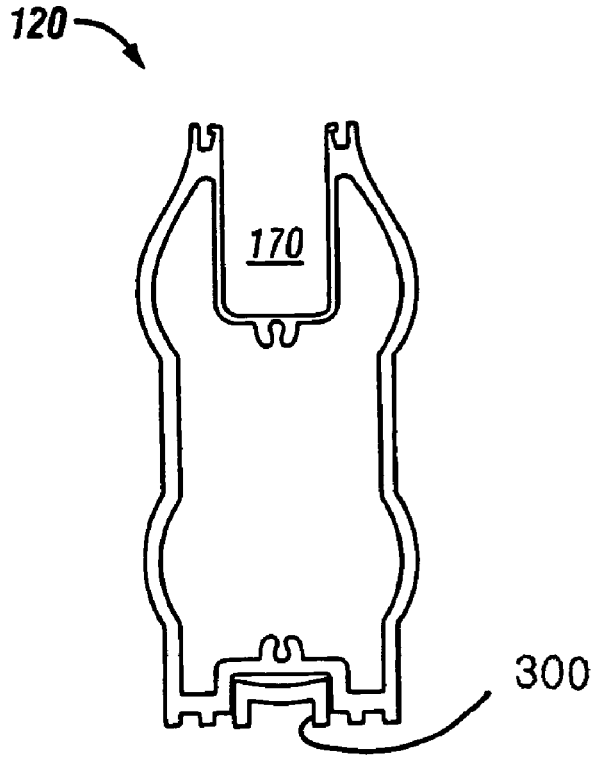
FIG. 3 is a cross-sectional view of an embodiment of an assembly in accordance with the present invention.

As best seen in FIG. 3, the columns 120,130 include a recess 170 structured to secure the clamping columns 120, 130 to the bottom edge 180 of the panel 110. According to some embodiments, the columns 120,130 are tapered toward the top recessed end such that they have a teardrop-shaped cross-section. The clamping columns 120,130 clamp the panel 110 such that the panel 110 is raised off ground and there is a resulting gap between columns 120,130 and beneath the panel 110. The rails 140,150 are adapted to span the gap to block dust, air, light and pests from getting in. An advantage of this design is that no notches need to be made in the panel 110 to accommodate for the height of the column 120,130, thereby providing a costs savings.

Figure 4:
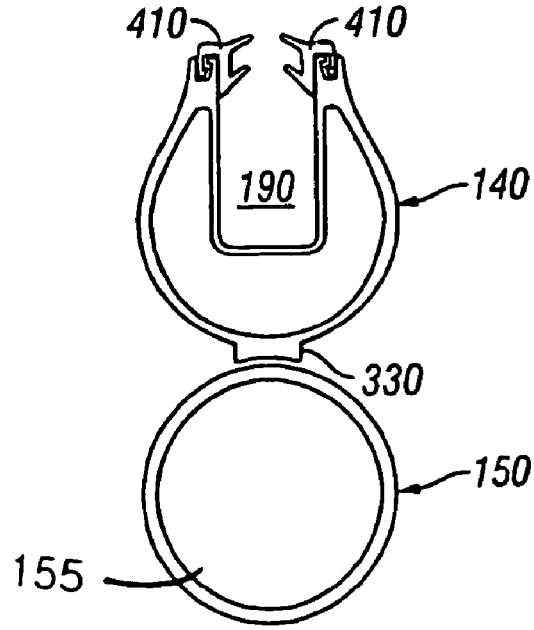
FIG. 4 is a cross-sectional view of an embodiment of an assembly in accordance with the present invention.

As best seen in FIG. 4, the first rail 140 includes a similarly shaped recess 190 structured to accommodate the bottom edge 180. The columns 120,130 are adapted to be slipped onto the bottom edge 180 of the panel 110 and clamped thereto. The process of clamping a panel to a rail system is described in detail in U.S. application Ser. No. 09/631,148, which is hereby incorporated by reference.

According to some embodiments, both the first rail 140 and the clamping columns 120,130 are tapered toward the top recessed end such that they have a teardrop-shaped cross-section. The teardrop shape meets the Americans with Disabilities Act standards, which require a taper of at least 60 degrees from a vertical plane. Having such a taper prevents a footrest from a wheelchair, for example, from getting caught on top of a railing or column. An additional advantage of the first rail 140 being round is that it is easy to bend around corners. According to other embodiments, the rail 140 and columns 120,130 may have other cross-sections, such as square cross-sections.

In some embodiments, the first rail 140 and the columns 120,130 are formed of aluminum and are manufactured by extrusion. Since both sides of the first rail 140 and columns 120,130 may be visible, it is preferable to use an attractive finish, such as satin anodize, black anodize or bronze anodize. Alternatively, conventional cladding, such as brass plates, may be placed over the exposed surfaces of housing 102 by conventional means, such as an adhesive.

According to some embodiments, the second rail 150 is a cylinder having a 2-inch diameter. Importantly, 2-inch diameter tubes can be purchased off the shelf in a variety of accent materials including, but not limited to wood, stone, stone, acrylic, metal and glass. In addition, the second rail may be a transparent tube containing a light source 155. According to other embodiments, the second rail 150 may be a cylinder having a diameter other than 2 inches. Still other embodiments may include a second rail 150 having an alternative cross-section, such as a square or triangular cross-section.

As seen in FIG. 1, each clamping column 120,130 includes a rail coupler 340 on one side and an end cap 370 on the other side. The rail couplers 340 are used to attach the first and second rails 140,150 between the columns 120,130. The rail couplers are secured to the columns using conventional means, such as by screws, adhesive, or, alternatively, by other means such as by a force fit or friction fit.

Figure 6:
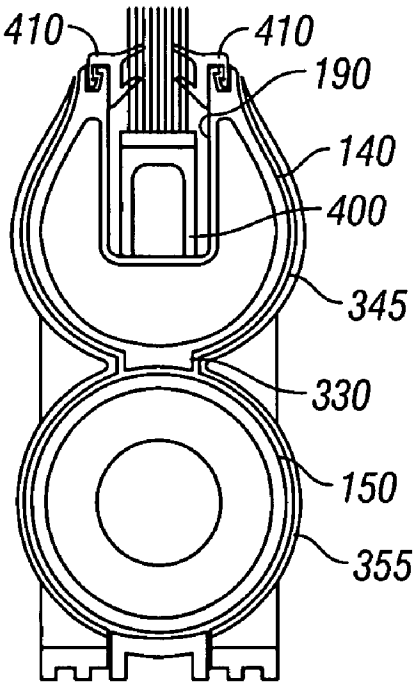
FIG. 6 is a cross-sectional view of an embodiment of an assembly in accordance with the present invention.
Figure 5:
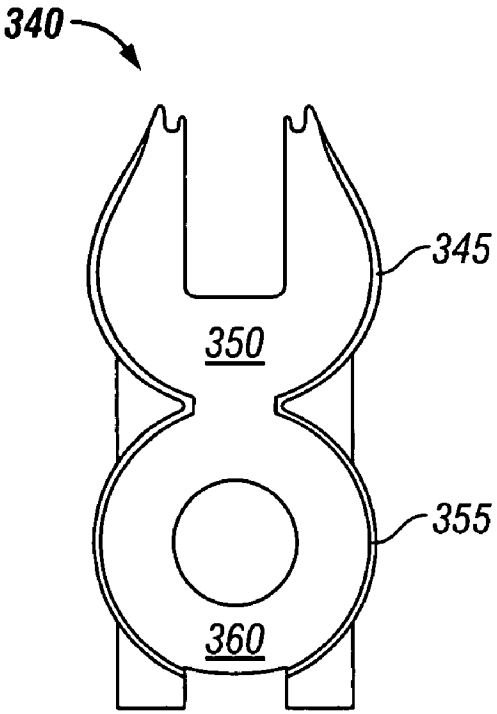
FIG. 5 is a cross-sectional view of an embodiment of an assembly in accordance with the present invention.

As best seen in FIGS. 5 and 6, each coupler 340 includes an upper coupling section 345 having an opening 350 and a lower coupling section 355 having an opening 360. Opening 350 is dimensioned to secure an end of the first rail 140 and opening 360 is dimensioned to secure an end of the second rail 150. A setting block 400 and installation gaskets 410 can be used to better secure panel 110 within recess 190. In addition, vinyl may be rolled into empty spaces within the recess 190 to provide a cushioning effect.

Figure 7:
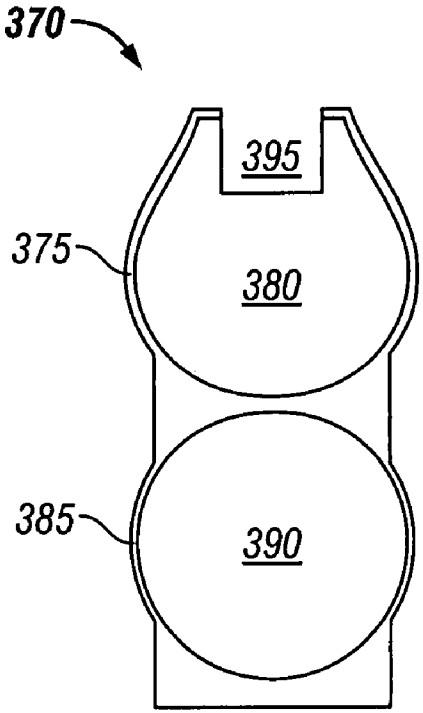
FIG. 7 is a cross-sectional view of an embodiment of an assembly in accordance with the present invention.

As seen in FIG. 7, each end cap 370 includes an upper coupling section 375 having an opening 380 and a lower coupling section 385 having an opening 390. Opening 380 is dimensioned to secure an end of the first rail 140 and opening 390 is dimensioned to secure an end of the second rail 150. End caps 370 are secured at an end of columns 120,130 by screws, adhesive, or, alternatively, by other means such as by a force fit or friction fit.

Advantageously, the end caps 370 provide an aesthetically attractive, removable surface at the end of columns 120,130 and appear as an extension of the first and second rails 140,150 through the columns 120,130. The end caps 370 further include recesses 395 dimensioned to accommodate the bottom edge 180 of the panel 110. The end caps 370 and rail couplers 340 may match columns 120,130 or rails 140,150 or both in appearance. Alternatively, the modular nature of system 100 allows columns 120,130, rails 140,150, end caps 370 and rail couplers 340 to be mixed and matched in a virtually limitless number of configurations.

Positioned between the rails 140,150, is gap filler 330, which fills a space that would otherwise exist between rails 140,150. According to some embodiments, the gap filler 330 is an integral and continuous extension of the first rail 140 that projects from the bottom end of the first rail 140. The gap filler 330 is dimensioned to fit the contour of the bottom rail 150 such that the gap is eliminated. The gap filler advantageously blocks dust, air, light and pests from getting in and also provides structural integrity and rigidity.

According to some embodiments, modular rail system 100 also extends along a top edge 175 of the panel 110, as seen in FIG. 1. Other embodiments (not shown) feature a modular rail system 200 that further extends along left and right edges 185,195 of the panel 110. Generally, glass doors only have rails at the top and bottom of the door. Wall partitions may have rails at the top, bottom and sides.

In other embodiments, column sections 120,130 can be used in full length to span the bottom edge of a pane of glass for a glass door. Unlike conventional rail columns that are bonded to the glass, column sections 120,130 can be recycled because they can be easily removed from the (broken) glass if needed and reused with anew glass pane. In addition, the column sections 120,130 can be mitered in both planes to provide corners in the horizontal or vertical planes.

Figure 2:
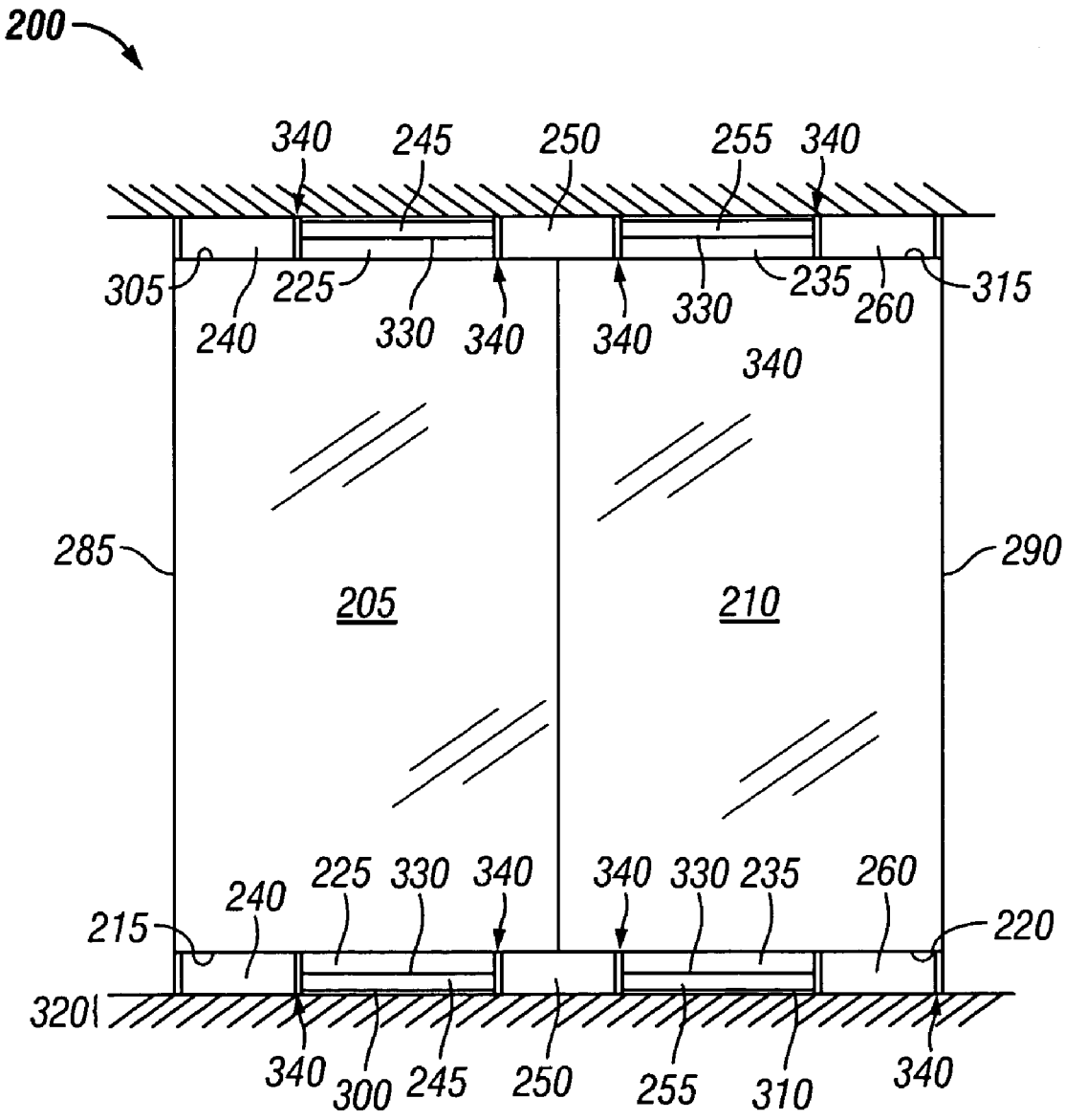
FIG. 2 is a front view of an embodiment of an assembly in accordance with the present invention.

FIG. 2 shows an embodiment of a modular rail system 200 for holding a pair of adjacent panels 205,210 according to the present invention. In this embodiment, the panels 205,210 are sidelites and the columns are stationary columns 240,250,260. Modular rail system 200 extends along bottom edges 215,220 of the panels 205,210 and includes a first stationary column 240, a second, middle stationary column 250 and a third stationary column 260, wherein the second stationary column 250 is positioned in between the first and third stationary columns 240,260.

The system further includes first 225,235 and second 245,255 tiers of rails extending between the stationary columns 240,250,260. The rails 225,235,245,255 are similar to those described above with respect to FIG. 1. As seen in FIG. 2, the end columns 240,260 include a rail coupler 340 on one side and an end cap 370 on the other side. Middle column 250 includes a rail coupler on both sides. The rail couplers 340 and end caps 370, are also similar to those described above with respect to FIG. 1.

The stationary columns 240,250,260 are adapted to be fixedly attached to the ground by screws, bolts, rivets, nails or other fasteners. The columns 240,250,260 are tapered toward the top recessed end such that they have a teardrop-shaped cross-section. Alternatively, the columns 240,250, 260 may have other cross-sections, such as square cross-sections As seen in FIG. 2, floor strips 300,310 are positioned between the second tier of rails 245, 255 and a supporting surface 320. According to some embodiments, the floor strips 300,310 are continuous strips under bottom rail. The floor strips 300,310 are dimensioned to fit the contour of the second 245,255 tiers of rails to eliminate a gap just above supporting surface 320. Like the gap filler 330, the floor strips 300,310 block dust, air, light and pests from getting in and provide structural integrity and rigidity to the system 200.

After attaching the columns 240,250,260, the panels 205,210 are slipped into place through recesses 270,280. As seen in FIG. 2, the first column 240 supports the lower left edge of panel 205, the third column 260 supports the lower right edge of panel 210 and the middle column 250 is positioned such that it supports both the lower right edge of panel 205 and the lower left edge of column 210.

According to some embodiments, modular rail system 200 also extends along a top edge 305,315 of the panels 205,210, as seen in FIG. 2. Other embodiments (not shown) feature a modular rail system 200 that further extends along a left edge 285 of panel 205 and along a right edge 290 of panel 210. As would be appreciated by one of ordinary skill in the art, additional columns and/or rails could be used to hold three or more adjacent panels, without departing from the scope of the present invention. In this fashion, additional modular components can be used to construct a rail system of any desired length.

Thus, it is seen that a modular rail system is provided. One skilled in the art will appreciate that the present invention can be practiced by other than the preferred embodiments which are presented in this description for purposes of illustration and not of limitation, and the present invention is limited only by the claims that follow. It is noted that equivalents for the particular embodiments discussed in this description may practice the invention as well.

What is claimed is:

1. A modular rail system comprising:

a first column;

a second column;

a first rail extending between the first and second columns; and a second rail extending between the first and second columns;

wherein the first column, second column and first rail each includes a recess configured to accommodate a common edge of a panel, wherein the recesses of the first column, second column and first rail are disposed substantially collinearly, and wherein the second rail comprises a transparent tube containing a light source.

2. The modular rail system of claim 1, further including a gap filler positioned between the first and second rails.

3. The modular rail system of claim 2, wherein the gap filler is integral with the first rail.

4. The modular rail system of claim 1, further including a floor strip positioned between the second rail and a supporting surface.

5. The modular rail system of claim 1, further including a rail coupler affixed to one side of each column.

6. The modular rail system of claim 5, wherein each coupler includes first and second recesses.

7. The modular rail system of claim 6, wherein the first recesses are dimensioned to secure ends of the first rail and the second recesses are dimensioned to secure ends of the second rail.

8. The modular rail system of claim 5, further including an end cap affixed to another side of each column.

9. The modular rail system of claim 8, wherein each end cap appears to be an extension of the first and second rails.

10. The modular rail system of claim 1, wherein the first and second columns are clamping columns that are adapted to be secured to the edge of the panel.

11. The modular rail system of claim 1, wherein the first rail is tapered toward the recess such that the first rail has a teardrop shape.

12. The modular rail system of claim 1, wherein the first rail is an extruded tube having a teardrop-shaped cross-section.

13. A modular rail system comprising:

a first column;

a second column;

a first rail extending between the first and second columns; and a second rail extending between the first and second columns;

wherein the first column, second column and first rail each includes a recess configured to accommodate a common edge of a panel, wherein the recesses of the first column, second column and first rail are disposed substantially collinearly, and wherein the first rail is tapered toward the recess such that the first rail has a teardrop shape.

14. The modular rail system of claim 13, wherein the second rail is made of one of the following materials: hardwood, stone, stone, metal and glass.

15. The modular rail system of claim 13, wherein the second rail comprises a transparent tube containing a light source.

16. A modular rail system for holding at least one panel comprising:

first, second and third columns, wherein the second column is positioned in between the first and third columns;

a first tier of rails including a plurality of rails extending between the first, second and third columns; and a second tier of rails including a plurality of rails extending between the first, second and third columns;

wherein the first column, second column, third column and first tier of rails each includes a recess configured to accommodate a common edge of the at least one panel, wherein the recesses of the first column, second column, third column and first tier of rails are disposed substantially collinearly, wherein the second tier of rails comprises at least one transparent tube containing a light source, and wherein the first and second columns are stationary columns affixed to a supporting surface.

17. The modular rail system of claim 16, further including a gap filler positioned between the first and second tiers of rails.

18. The modular rail system of claim 17, wherein the gap filler is integral with the first tier of rails.

19. The modular rail system of claim 16, further including a floor strip positioned between the second tier of rails and a supporting surface.

20. The modular rail system of claim 19, further including a rail coupler affixed to one side of the first and third columns.

21. The modular rail system of claim 20, further including a rail coupler affixed to two sides of the second column.

22. The modular rail system of claim 21, wherein each coupler includes first and second recesses.

23. The modular rail system of claim 22, wherein the first recesses are dimensioned to secure ends of the first tier of rails and the second recesses are dimensioned to secure ends of the second tier of rails.

24. The modular rail system of claim 20, further including an end cap affixed to another side of the first and third columns.

25. The modular rail system of claim 24, wherein each end cap appears to be an extension of the first and second tiers of rails.

26. The modular rail system of claim 16, wherein the columns are clamping columns that are adapted to be secured to the edge of the at least one panel.

27. The modular rail system of claim 16, wherein the first tier of rails is tapered toward the recess such that the rails have a teardrop shape.

28. The modular rail system of claim 16, wherein the first tier of rails comprises extruded tubes having a teardrop-shaped cross-section.

29. The modular rail system of claim 16, wherein the second tier of rails comprises cylinders having substantially a 2-inch diameter.

30. The modular rail system of claim 16, wherein the second tier of rails is made of one of the following materials: hardwood, stone, stone, metal and glass.

* * * * *